US009935366B2

(12) United States Patent
Sundström et al.

(10) Patent No.: US 9,935,366 B2
(45) Date of Patent: Apr. 3, 2018

(54) WIRELESS COMMUNICATION SYSTEM NODE ARRANGED FOR DETERMINING POINTING DEVIATION

(71) Applicant: TELEFONAKTIEBOLAGET LM ERICSSON (PUBL), Stockholm (SE)

(72) Inventors: Lars Sundström, Södra Sandby (SE); Lars Manholm, Göteborg (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 7 days.

(21) Appl. No.: 15/302,262

(22) PCT Filed: Apr. 10, 2014

(86) PCT No.: PCT/EP2014/057266

§ 371 (c)(1),
(2) Date: Oct. 6, 2016

(87) PCT Pub. No.: WO2015/154811

PCT Pub. Date: Oct. 15, 2015

(65) Prior Publication Data

US 2017/0033457 A1 Feb. 2, 2017

(51) Int. Cl.
*H01Q 3/26* (2006.01)
*H01Q 1/24* (2006.01)
(Continued)

(52) U.S. Cl.
CPC ..... *H01Q 3/2605* (2013.01); *H01Q 1/246* (2013.01); *H01Q 21/065* (2013.01); *H01Q 21/08* (2013.01)

(58) Field of Classification Search
CPC .... H01Q 3/2605; H01Q 1/246; H01Q 21/065; H01Q 21/08
(Continued)

(56) References Cited

U.S. PATENT DOCUMENTS

2011/0115665 A1 5/2011 Ryu
2013/0039345 A1 2/2013 Kim et al.

OTHER PUBLICATIONS

International Search Report and Written Opinion dated Dec. 10, 2014, in International Application No. PCT/EP2014/057266, 11 pages.

(Continued)

*Primary Examiner* — Graham Smith
(74) *Attorney, Agent, or Firm* — Rothwell, Figg, Ernst & Manbeck, P.C.

(57) ABSTRACT

The present invention relates to a wireless communication system node, which comprises an antenna arrangement, with at least one array antenna, each array antenna having a plurality of antenna elements. At least a first set of antenna elements is formed from said plurality of antenna elements. For at least one set of antenna elements, a control unit is arranged to:

Form an antenna beam that is steerable to a certain pointing angle in at least one plane for a signal having a certain bandwidth with a certain lowest frequency ($f_{low}$) and a certain highest frequency ($f_{high}$)

Determine the relative power of a received signal at a plurality of frequencies in the frequency band.

Determine a degree of angular pointing deviation ($\beta_b$, $\beta_c$) for the antenna beam relative the received signal by means of the degree of slant of the relative power of the received signal.

16 Claims, 9 Drawing Sheets

(51) Int. Cl.
*H01Q 21/06* (2006.01)
*H01Q 21/08* (2006.01)

(58) Field of Classification Search
USPC ..... 343/703
See application file for complete search history.

(56) References Cited

OTHER PUBLICATIONS

Matsumoto et al., "Satellite Interference Location System Using On-Board Multibeam Antenna", Electronics & Communications in Japan, Part 1—Communications, Wiley, Hoboken, NJ, US, vol. 80, No. 11, Part 01, Nov. 1, 1997 (Nov. 1, 1997), pp. 22-31, XP000723646, ISSN: 8756-6621, DOI: 10.1002(SICI)1520-6424(199711).

WIRELESS COMMUNICATION SYSTEM NODE ARRANGED FOR DETERMINING POINTING DEVIATION

CROSS REFERENCE TO RELATED APPLICATION(S)

This application is a 35 U.S.C. § 371 National Phase Entry Application from PCT/EP2014/057266, filed Apr. 10, 2014, designating the United States, the disclosure of which is incorporated herein in its entirety by reference.

TECHNICAL FIELD

The present invention relates to wireless communication system node which comprises an antenna arrangement. The antenna arrangement in turn comprises at least one array antenna, where each array antenna comprises a plurality of antenna elements. At least a first set of antenna elements is formed from said plurality of antenna elements.

The present invention also relates to a method for determining a degree of angular pointing deviation for a steerable antenna beam relative a received signal at a node with an antenna arrangement. The antenna arrangement in turn comprises at least one array antenna, where each array antenna comprises a plurality of antenna elements. At least a first set of antenna elements is formed from said plurality of antenna elements.

BACKGROUND

Future mmW-based radio access technology, such as for example between a base station/access node (eNB) and a UE (user equipment) such as a user terminal, or between two UE:s, will heavily rely on beam-forming. This is primarily due to a desire to acquire an acceptable path loss due to the small aperture of single antennas at those high frequencies, but is also due to a desire to compensate for the progressively reduced power capability of power amplifier and increased noise figure of receivers as the frequency of operation is increased.

Radio links, e.g. point-to-point, wireless backhaul for eNB etc., is another application that exploits beam-forming, but is different in that they typically are considered as being fixed and not moving, as is the case for a UE communicating with an eNB.

Beam-forming exhibits spatial selectivity that can be beneficial in a multi-user scenario. But it also leads to requirements on accurate beam tracking, which means estimating direction of a received beam and steer the antenna accordingly, for the transmission link not to become a victim of that same selectivity. This can be a severe problem even when UE:s move slowly, in case the beams are very narrow, having a beam width of about just a few degrees.

Generally, beam tracking is required foremost not to lose a radio link and better still to maintain the quality of the radio link between any two nodes when there is a movement of at least one of the nodes. While a moving UE connected to an eNB appears to be the most obvious case also radio links with very narrow beams can benefit from beam tracking as tiny movements due to vibrations or wind may have a large impact on the link quality. Beam tracking can be based on a combination of techniques including RSSI measurements in different beam directions and motion detectors in a UE (or any node) that in turn are used to steer the antenna beam of that same device.

There is thus a problem related to that the movement of UE:s may be too fast to correct for in the UE only by means beam tracking based on measurements of received signal strength.

In any case, additional techniques that can improve beam tracking are desirable to allow for more narrow beams.

It therefore exists a need to provide a more accurate measurement of the direction of a received beam, and more specifically the deviation from the desired beam direction.

SUMMARY

It is an object of the present invention to provide a node in a wireless communication system, where the node has an antenna arrangement that enables changing of the sector width in wireless cellular networks where all beams are matched to the new sector width.

Said object is obtained by means of a wireless communication system node which comprises an antenna arrangement. The antenna arrangement in turn comprises at least one array antenna, where each array antenna comprises a plurality of antenna elements. At least a first set of antenna elements is formed from said plurality of antenna elements. The node comprises a control unit where, for at least one set of antenna elements, the control unit is arranged to:

- Form an antenna beam that is steerable to a certain pointing angle in at least one plane by means of phase shifts applied to the antenna elements in said set of antenna elements. The antenna beam is formed for a signal having a certain bandwidth with a certain lowest frequency, a certain highest frequency, and a certain centre frequency. The centre frequency is symmetrically located between the lowest frequency and the highest frequency.
- Determine the relative power of a received signal at a plurality of frequencies in the frequency band, from the lowest frequency to the highest frequency.
- Determine a degree of angular pointing deviation for the antenna beam relative the received signal by means of the degree of slant of the relative power of the received signal, from the lowest frequency to the highest frequency.

Said object is also obtained by means of a method for determining a degree of angular pointing deviation for a steerable antenna beam relative a received signal at a node with an antenna arrangement. The antenna arrangement in turn comprises at least one array antenna, where each array antenna comprises a plurality of antenna elements. At least a first set of antenna elements is formed from said plurality of antenna elements. The method comprises the steps:

- Forming said steerable antenna beam, which is steerable to a certain pointing angle in at least one plane by means of phase shifts applied to the antenna elements in said set of antenna elements. The antenna beam is formed for a signal having a certain bandwidth with a certain lowest frequency, a certain highest frequency, and a certain centre frequency which is symmetrically located between the lowest frequency and the highest frequency.
- Determining the relative power of a received signal at a plurality of frequencies in the frequency band, from the lowest frequency to the highest frequency.
- Determining the degree of angular pointing deviation for the antenna beam relative the received signal by means of the degree of slant of the relative power of the received signal, from the lowest frequency to the highest frequency.

According to an example, each set of antenna elements comprises those antenna elements that are positioned closer to a straight line than any other antenna elements along said line.

According to another example, at least one array antenna comprises a plurality of antenna elements in two dimensions in a plane. The first set of antenna elements comprises those antenna elements that are positioned closer to a first straight line than any other antenna elements along said first straight line, and a second set of antenna elements from said plurality of antenna elements comprises antenna elements that are positioned closer to a second straight line than any other antenna elements along said second straight line. The second straight line has an extension with a direction that differs from the direction of the first straight line's extension. The control unit is arranged to determine a degree of angular pointing deviation for the antenna beam relative the received signal for the second set of antenna elements in the same way as for the first set of antenna elements.

According to another example, the control unit is arranged to alter which antenna elements that are comprised in the sets of antenna elements such that those parts of an incoming signal that reach the array antenna, reach the second straight line as simultaneous as possible. For example, this determining is based on determined relative power of a received signal at a plurality of frequencies in the frequency band, from the lowest frequency to the highest frequency at different directions of said antenna beam along at least one plane.

According to another example, the control unit is arranged to determine a degree of angular pointing deviation for the received signal relative the antenna beam by means of the degree of slant of the relative power of a received signal from the lowest frequency to the highest frequency along the second set of antenna elements.

Other examples are disclosed in the dependent claims.

A number of advantages are obtained by means of the present invention. Mainly an improved beam tracking accuracy and speed is obtained by means measurement of spectrum slanting using an antenna array designed to obtain this slanting whenever there is a significant deviation from the ideal beam direction. Optionally, the present invention confers the ability to detect spectrum slanting of transmitting node and communicating that to said transmitting node to improve its beam tracking as well.

BRIEF DESCRIPTION OF THE DRAWINGS

The present invention will now be described more in detail with reference to the appended drawings, where.

DETAILED DESCRIPTION

Figure 1:
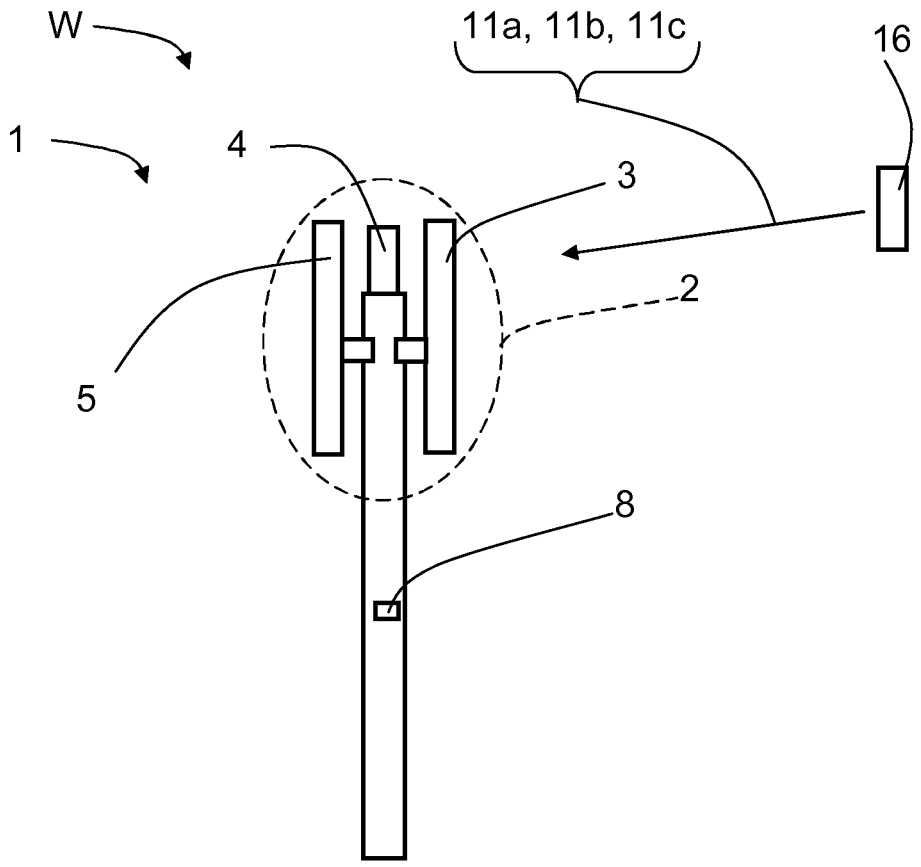
FIG. 1 shows a schematical view of a node in a wireless communication system.

With reference to FIG. 1, there is a node 1 in a wireless communication system W, constituting a wireless communication system node 1. The node 1 comprises an antenna arrangement 2 and a control unit 8. The antenna arrangement 2 in turn comprises a first array antenna 3, a second array antenna 4, and a third array antenna 5. In the following, only the first array antenna 3 will be discussed, and all features of the first array antenna 3 are applicable for the other array antennas as well. Generally, the node may comprise any suitable number of array antennas, for example only one array antenna which then would be constituted by the first array antenna 3.

Figure 2:
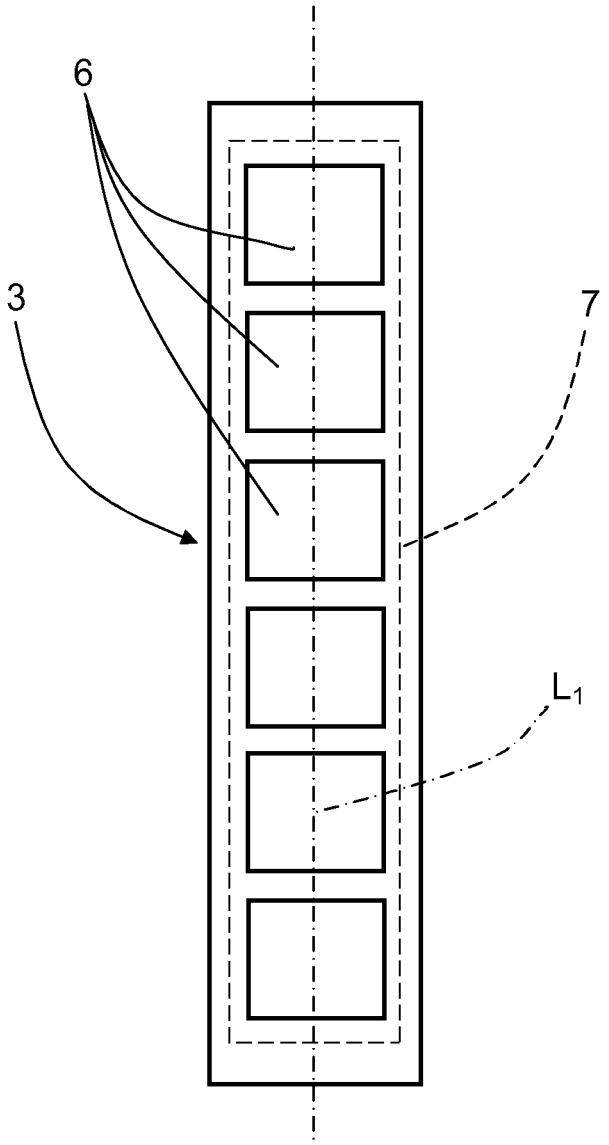
FIG. 2 shows a first example of an array antenna.

With reference to FIG. 2, showing a first example, the first array antenna 3 comprises a plurality of antenna elements 6 (only a few indicated in FIG. 2 for reasons of clarity) in a row along a first straight line $L_1$. Here, all the antenna elements 6 form a first set of antenna elements 7.

The control unit 8 is arranged to form an antenna beam 9*a*, as shown on FIG. 3, that is steerable to different pointing angles $\varphi_1$, $\varphi_2$ as shown for a first steered antenna beam 9*b* in FIG. 4 and a second steered antenna beam 9*c* in FIG. 5, which antenna beams will be discussed more below. This is accomplished by means of phase shifts applied to the antenna elements 6 in the set of antenna elements 7.

The antenna beam is formed for a signal having a certain bandwidth B with a certain lowest frequency $f_{low}$, a certain highest frequency $f_{high}$, and a certain centre frequency $f_c$, symmetrically located between the lowest frequency $f_{low}$ and the highest frequency $f_{high}$.

An incoming and received signal 11*a*, 11*b*, 11*c* from a user terminal 16 as shown in FIG. 1 reaches the first array antenna 3 as a wavefront. The wavefront will reach the antenna elements 6 along the antenna array at different time instances, here represented by a time offset $t_d$, whenever the wavefront is not in parallel with the array antenna 3.

Beam-forming by using phase shifts as mentioned above will be frequency dependent. When the bandwidth B of the signal relative to its centre frequency $f_c$ is quite small, this dependency on frequency will have a negligible effect on the beam forming. But if the frequency range to support, and thus the bandwidth B of the signal relative to its centre frequency $f_c$ is relatively large, the effect will be a beam pointing in different directions at different frequencies, so called beam squinting.

Figure 3:
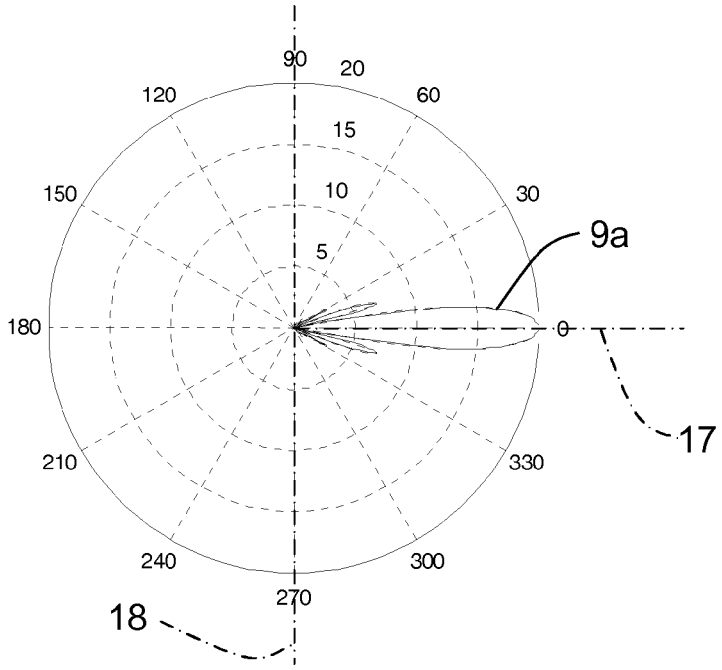
FIG. 3 shows an antenna beam in a first direction.
Figure 4:
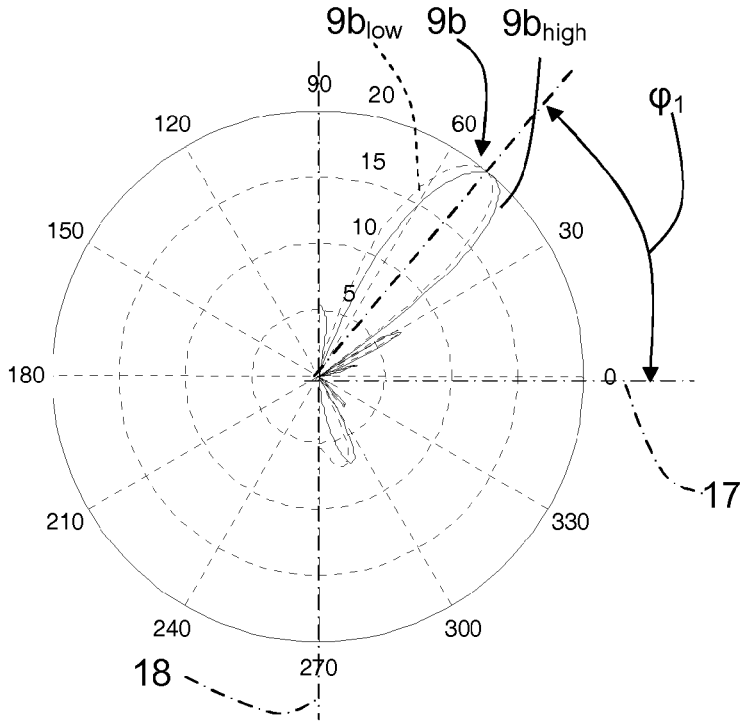
FIG. 4 shows an antenna beam in a second direction.
Figure 5:
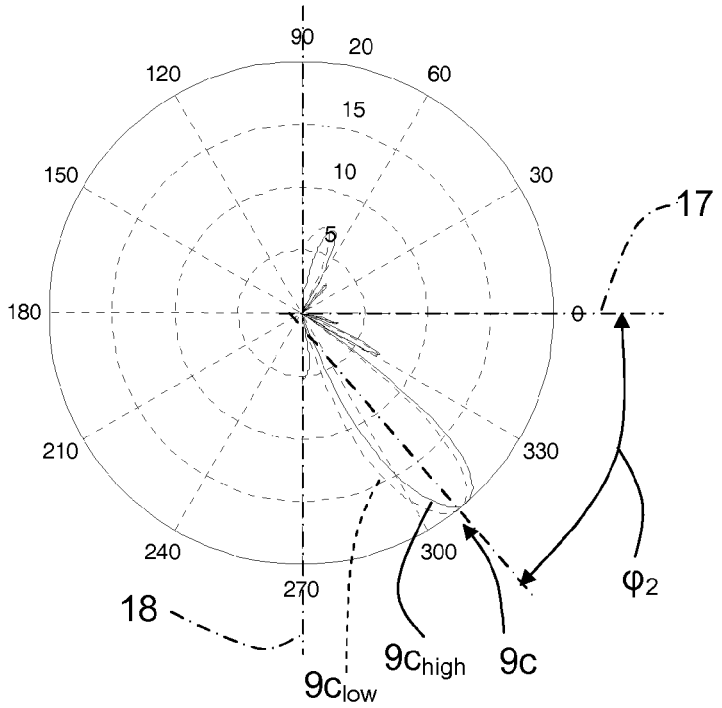
FIG. 5 shows an antenna beam in a third direction.

This is illustrated in FIG. 3, FIG. 4 and FIG. 5, where differently steered antenna beams 9*a*, 9*b*, 9*c* are shown as briefly mentioned above, the antenna beams 9*a*, 9*b*, 9*c* being shown for the lowest frequency $f_{low}$ and the highest frequency $f_{high}$. As the array antenna 3 is symmetric with respect to the direction of the beam, the radiation pattern for the two frequencies will be indistinguishable in FIG. 3, where the antenna beam 9*a* is steered to a pointing angle $\varphi=0°$ with respect to a boresight plane 17 that is perpendicular to an element plane 18 in which the antenna elements 6 lie.

However, for a first pointing angle $\varphi_1$, there is a clearly visible difference in FIG. 4, where the first steered antenna beam 9*b* is comprised by a plurality of antenna beams for different frequencies within the frequency band B; here a low frequency first steered antenna beam $\mathbf{9}b_{low}$ for the lowest frequency $f_{low}$ and a high frequency first steered antenna beam $\mathbf{9}b_{high}$ for the highest frequency $f_{high}$ are shown.

In the same way, for a second pointing angle $\varphi_2$, there is a clearly visible difference in FIG. 5, where the first steered antenna beam 9*b* is comprised by a plurality of antenna beams for different frequencies within the frequency band B; here a low frequency second steered antenna beam $\mathbf{9}c_{low}$ for the lowest frequency $f_{low}$ and a high frequency second steered antenna beam $\mathbf{9}c_{high}$ for the highest frequency $f_{high}$ are shown.

Figure 6:
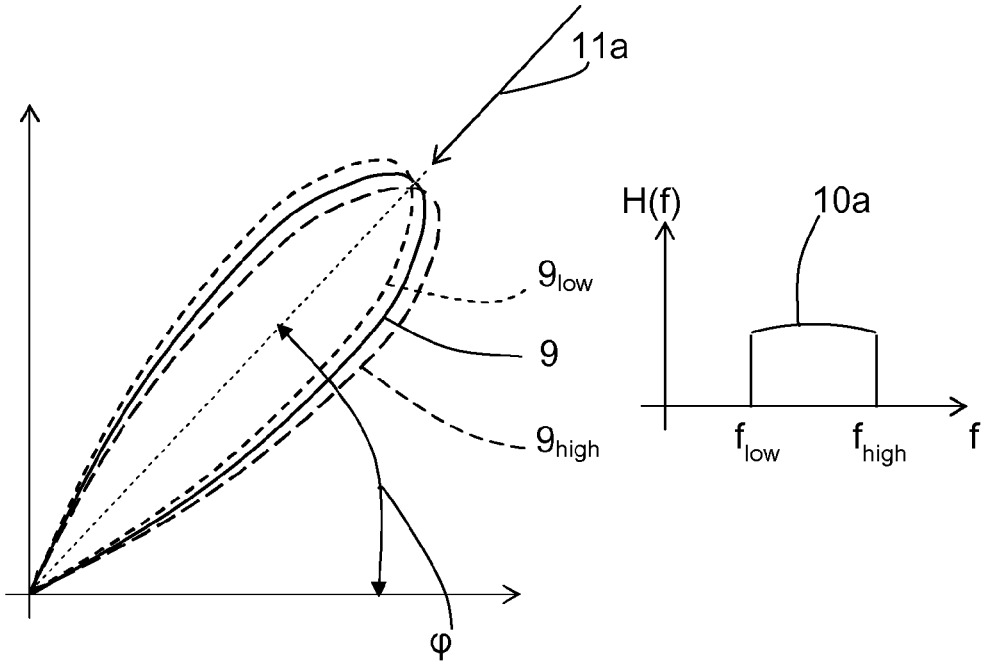
FIG. 6 shows an antenna beam in a second direction without angular pointing deviation, and received relative power as a function of frequency.
Figure 7:
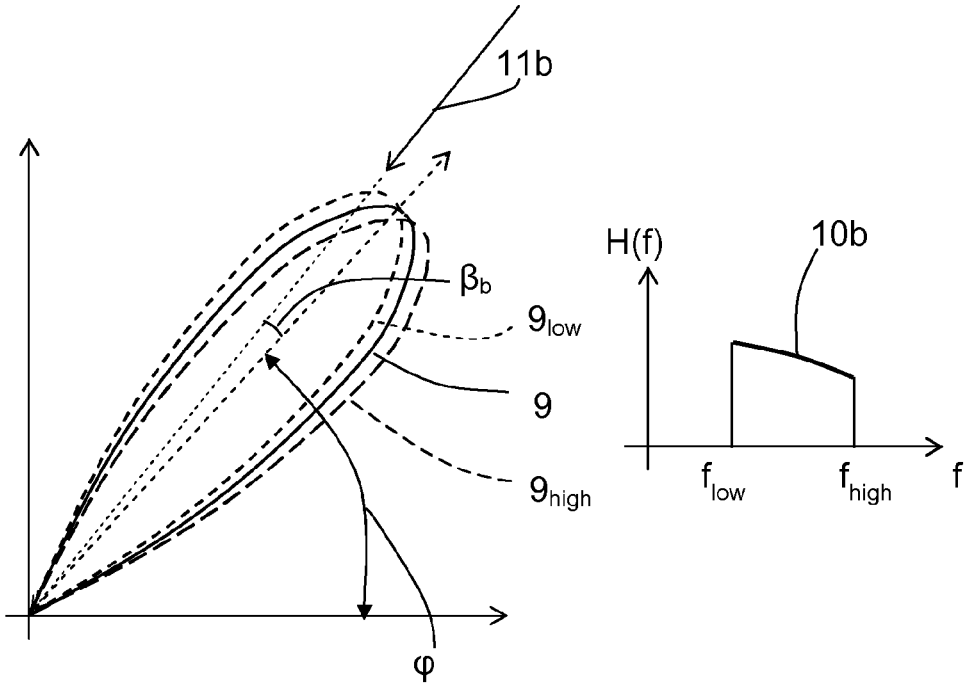
FIG. 7 shows an antenna beam in a second direction with a first angular pointing deviation, and received relative power as a function of frequency.
Figure 8:
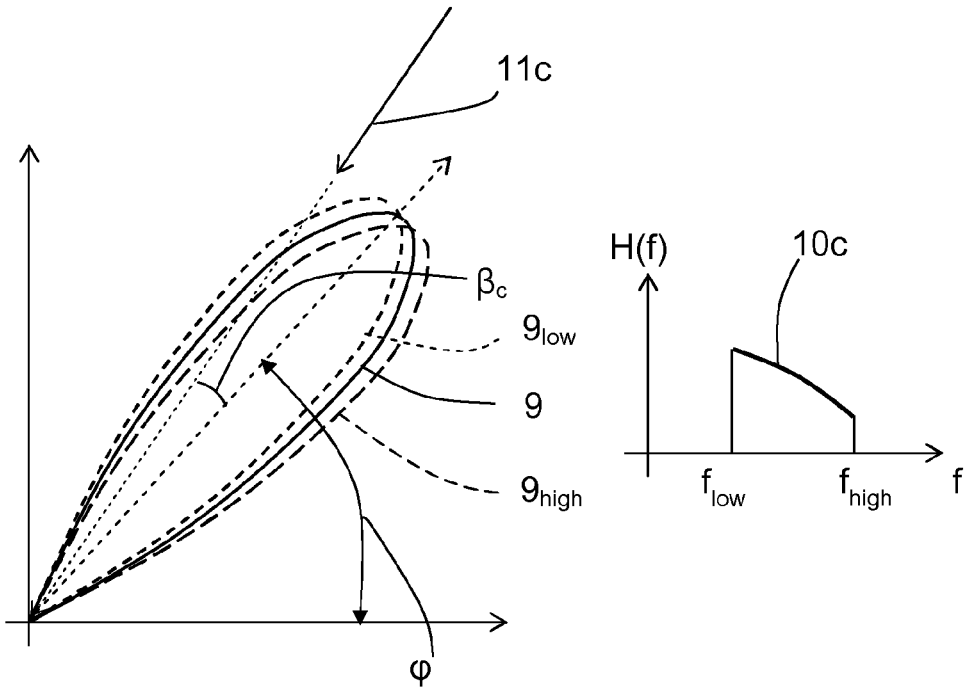
FIG. 8 shows an antenna beam in a second direction with a second angular pointing deviation, and received relative power as a function of frequency.

According to the present invention, with reference to FIG. 6, FIG. 7 and FIG. 8, the control unit 8 is arranged to determine the relative power 10*a*, 10*b*, 10*c* of a received signal 11*a*, 11*b*, 11*c* at a plurality of frequencies in the frequency band B, from the lowest frequency $f_{low}$ to the highest frequency $f_{high}$. The control unit 8 is also arranged to determine a degree of angular pointing deviation $\beta_b$, $\beta_c$ for the antenna beam 9*a*, 9*b*, 9*c* relative the received signal 11*a*, 11*b*, 11*c* by means of the degree of slant of the relative power 10*a*, 10*b*, 10*c* of the received signal 11*a*, 11*b*, 11*c*, from the lowest frequency $f_{low}$ to the highest frequency $f_{high}$.

This will now be discussed more in detail, with continued reference to FIG. 6, FIG. 7 and FIG. 8, where there is a centre frequency antenna beam 9, corresponding to the centre frequency $f_c$, directed at a certain pointing angle $\varphi$, a low frequency antenna beam $\mathbf{9}_{low}$, corresponding to the lowest frequency $f_{low}$, and a high frequency antenna beam $\mathbf{9}_{high}$, corresponding to the highest frequency $f_{high}$. In each one of FIG. 6, FIG. 7 and FIG. 8, a magnitude of received relative power H(f) is shown as a function of frequency.

A shown in FIG. 6, the direction of a first incoming and received signal 11*a* aligns with that of the pointing angle $\varphi$ of the centre frequency antenna beam 9. This results in that a first received relative power 10*a* from the lowest frequency $f_{low}$ to the highest frequency $f_{high}$ gets a small and symmetric droop when going from the centre frequency $f_c$ toward any one of the lowest frequency $f_{low}$ and the highest frequency $f_{high}$, respectively.

However, with reference to FIG. 7, when there is a small angular deviation $\beta_b$ between the direction of the incoming received signal 11*b* and that of the pointing angle $\varphi$ of the centre frequency antenna beam 9, a second received relative power 10*b* from the lowest frequency $f_{low}$ to the highest frequency $f_{high}$ gets a continuous slant.

Furthermore, with reference to FIG. 8, when there is a larger angular deviation $\beta_c$ between the direction of the incoming received signal 11*c* and that of the pointing angle $\varphi$ of the centre frequency antenna beam 9, a third received relative power 10*c* from the lowest frequency $f_{low}$ to the highest frequency $f_{high}$ gets a continuous slant with a higher degree of inclination then the one described with reference to FIG. 7.

From the above it is clearly seen that by measuring the degree of slanting, for example by spectrum center of gravity, spectrum slope or simply a power ratio between a fraction of the lower and upper parts of the signal spectrum, this value can then be mapped to the sign and size of the angular pointing deviation $\beta_b$, $\beta_c$.

From FIG. 4 and FIG. 5 it is shown that the low frequency steered antenna beams $\mathbf{9}c_{low}$, $\mathbf{9}c_{low}$ always point at a higher angle of direction, i.e. away from the boresight plane 17, and this can exploited to determine the direction of the beam deviation with respect to the actual signal being received, i.e. the sign of the angular deviation can be determined.

Figure 9:
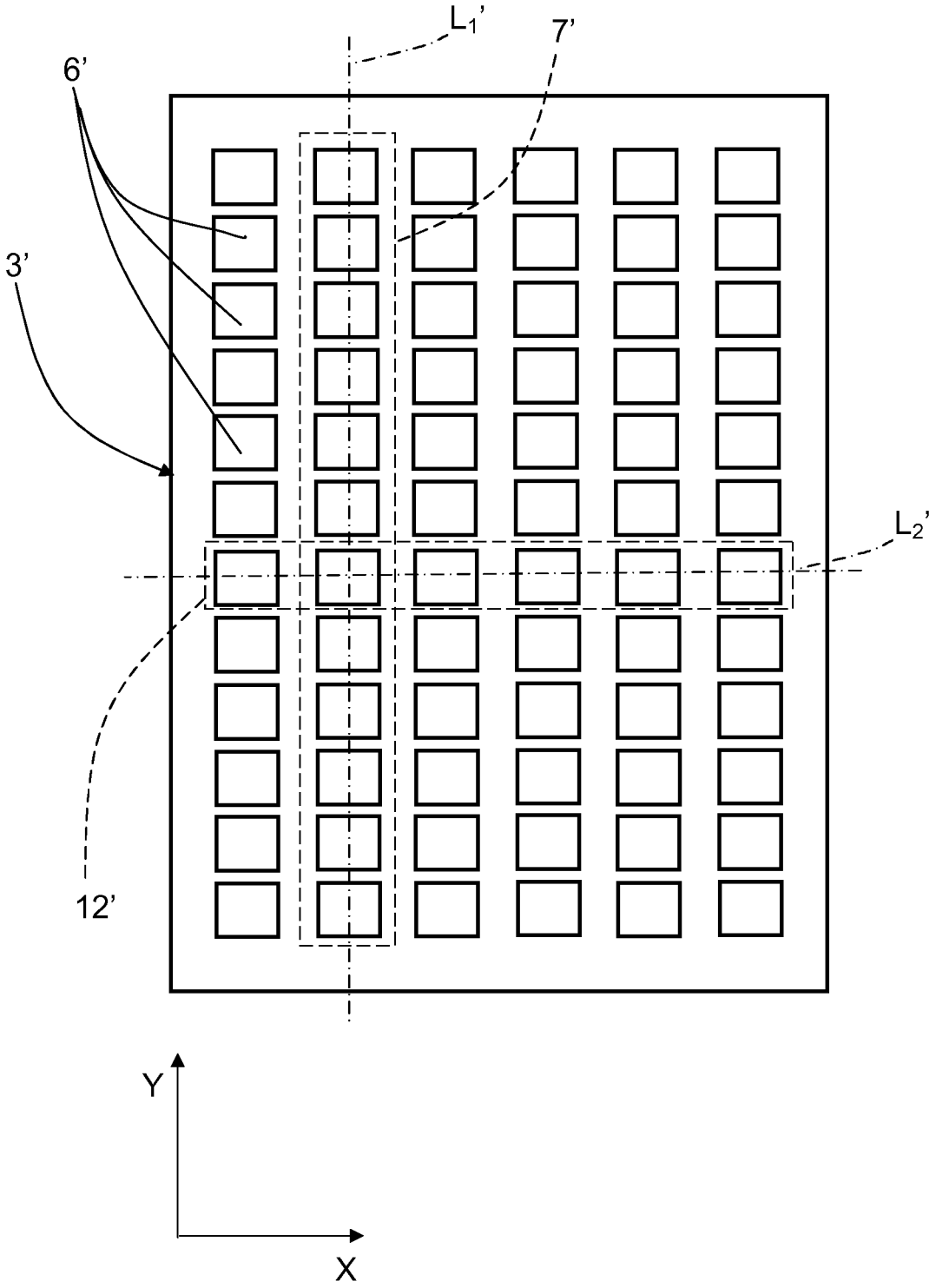
FIG. 9 shows a second example of an array antenna.
Figure 10:
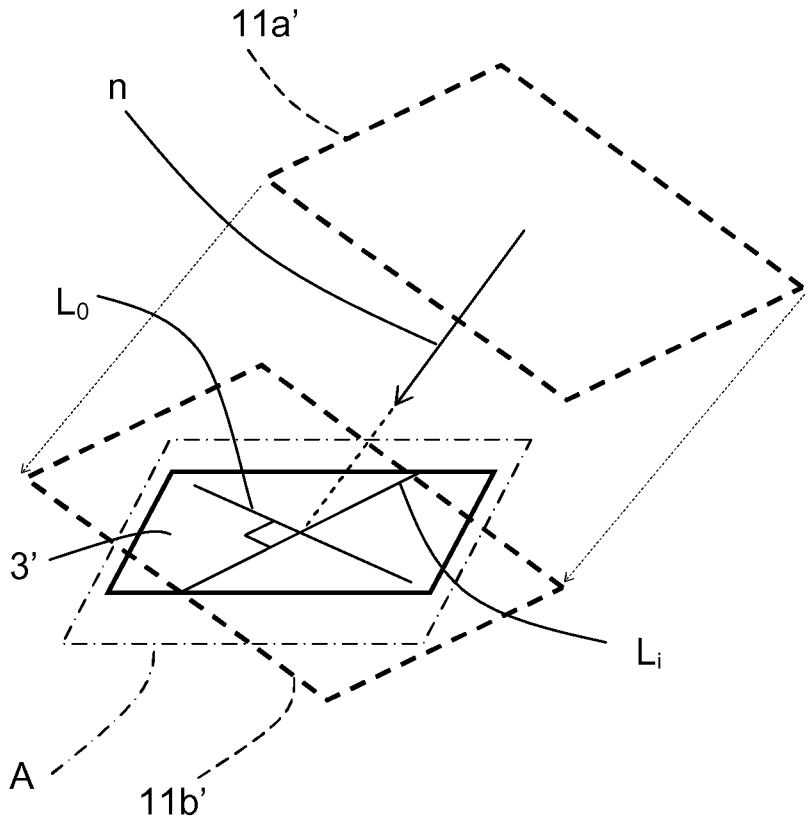
FIG. 10 shows a signal wavefront incoming towards the array antenna of FIG. 9.

The above first example is based on a one-dimensional antenna. With reference to FIG. 9 and FIG. 10, showing a second example, an array antenna 3' comprises a plurality of antenna elements 6' (only a few indicated in FIG. 9 for reasons of clarity) in two dimensions x, y in a plane A.

FIG. 10 illustrates a signal 11*a*', 11*b*' that propagates towards the plane A of the array antenna 3' with the signal represented at a first position by a first wavefront plane 11*a*' with a direction represented by normal n. The signals is also shown at a second position represented by a second wavefront plane 11*b*', shifted along the direction n to where it intercepts with the plane A of the array antenna array 3' along a first signal line $L_i$. Furthermore a second signal line $L_o$ is defined in the plane A as being perpendicular to the first signal line $L_i$.

From FIG. 10 it can be understood that all antenna elements along the first signal line $L_i$, or along any line in parallel with the first signal line $L_i$, will receive the incoming signal simultaneously. Thus, time shifts only occurs along the second signal line $l_o$ and along lines in parallel with the second signal line $L_o$.

This means that the one-dimensional view of time shift, as discussed for the first example, and its effect on spectrum slanting still applies. However, when all antenna elements are combined to form a beam in a certain direction there is no way to tell the direction of the two dimensional angular deviation, the slanting will only indicate the magnitude of the deviation. To solve this issue, two or more sets of antenna elements from said plurality of antenna elements 6' are used, as shown in FIG. 9.

Here, a first set of antenna elements 7' from said plurality of antenna elements 6' is formed along a first straight line $L_1$', and a second set of antenna elements 12' from said plurality of antenna elements 6' is formed along a second straight line L2'. In this example, the first straight line L1' and the second straight line L2' are mutually perpendicular.

Each set of antenna elements 7', 12' can then be used to calculate the deviation in their respective dimension. The control unit 8 is then arranged to determine a degree of angular pointing deviation for the antenna beam 9*a*, 9*b*, 9*c* relative the received signal 11*a*', 11*b*' for the first set of antenna elements 7' and the second set of antenna elements 12' in the same way as for the first set of antenna elements 7 in the first example.

The angular pointing deviation βb, βc may be defined for each set of antenna elements 7', 12' in a similar way as shown in FIG. 7 and FIG. 8 in this example as well, although initially described for the first array antenna 3, these figures being referred to as a general reference in this second example as well. The detected angular pointing deviation βb, βc will be used to determine an effective angular pointing deviation. In other words, the detected angular pointing deviation for each set of antenna elements 7', 12' provides an angular pointing deviation in two dimensions, as defined by the respective set of antenna elements 7', 12', which in turn can be used to calculate an effective angular pointing deviation in two other dimensions as used when steering the antenna beam, such as for example the commonly used azimuth-elevation dimensions in a spherical coordinate system.

The control unit 8 is arranged to alter which antenna elements that are comprised in the sets of antenna elements 7', 12' such that those parts of an incoming signal 11b' that reach the array antenna 3', reach the second straight line L2' as simultaneous as possible.

In order to determine which antenna elements that are going to be comprised in the second set of antenna elements 12', the relative power of a received signal 11b' at a plurality of frequencies is determined in the frequency band B, from the lowest frequency $f_{low}$ to the highest frequency $f_{high}$ at different directions of said antenna beam along at least one plane.

Figure 11:
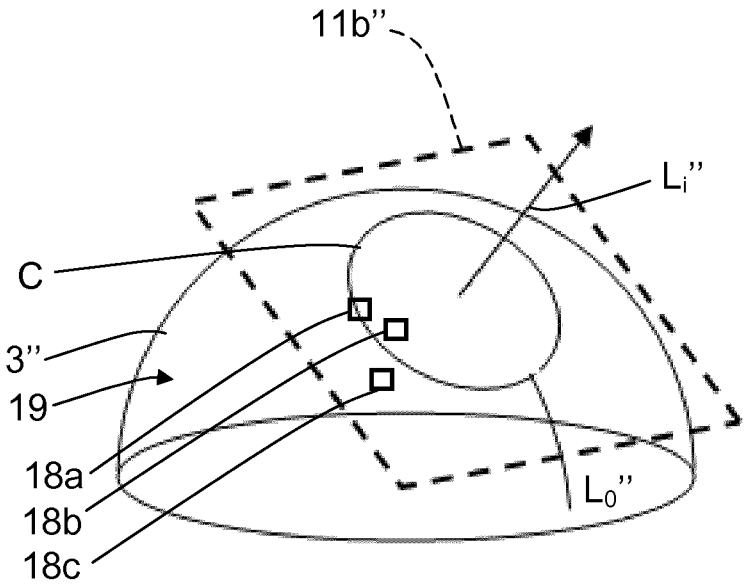
FIG. 11 shows a third example of an array antenna with an incoming signal wavefront.

When the antenna array 3' is symmetric with respect to the beam direction, i.e. φ=0°, there is no beams angle frequency dependency. However, even for this case, it is possible to obtain beam angle frequency dependency with a conformal array antenna 3" according to a third example, as shown in FIG. 11. Here, antenna elements 18a, 18b, 18c (only a few are shown in FIG. 11 for reasons of clarity) are placed on the surface of a half-sphere 19.

The intersection of an incoming and received wavefront 11b" and the surface of the half-sphere 19 will yield a signal circle $L_o$" that corresponds to the second signal line $L_o$ in the planar case of the second example. That is, those antenna elements, here represented by a first antenna element 18a, that are located on such a signal circle, or any parts thereof, will receive the signal 11b' simultaneously, where as any other line segment will not and therefore serve the same purpose as the first signal line $L_i$ in the planar case, here represented by a signal arrow $L_i$". In this case, a suitable set of antenna elements that is formed from the antenna elements 18a, 18b, 18c, would not be following, or at least partly following, a line, but instead a circle.

Generally, obtaining beam angle frequency dependency at φ=0° is obtained by having an antenna system extending into a third dimension. For example two or more two-dimensional antenna arrays can be rotated differently in three dimensions, or a conformal antenna where elements are placed on any suitable three-dimensional shape such as a half-sphere as discussed above. Based on the beam direction, different sets of antenna elements from the antennas arrays are used so as to obtain a frequency dependent beam direction. Those sets may be formed in any suitable way, not having to follow a straight line or a circle.

Furthermore, the described effect of spectrum slanting may not only occur on the receiver side. If a signal is received in a direction different from the configured transmitter beam, and the beam width is comparable to that of the receiver (or smaller), then there can be a spectrum slanting already before considering the effect of the receiver antenna. In this case, with reference to FIG. 9 and FIG. 10, one of the following methods may be used to distinguish the spectrum slanting of the receiver from that of the transmitter:

According to a first method, under the assumption that the direction of the antenna beam 9 is approximately correct, an initial set of antenna elements is formed essentially in parallel with the first signal line $L_i$, here referring to the assumed beam direction as opposed to the direction of the actual incoming and received wavefront. The signals received from this initial set of antenna elements are combined to generate a signal from which spectrum slanting should be detected, which will roughly correspond to the spectrum slanting of a transmitter in a transmitting node such as the user terminal 16 in FIG. 1.

Such a set of antenna elements will only present a relatively small degree of spectrum slanting depending on the accuracy of present antenna beam angular direction φ, and the ability to form a set of antenna elements in parallel with the first signal line $L_i$. Furthermore, an additional set of antenna elements is formed that is essentially in parallel with the second signal line $L_o$ and thus will see a spectrum slanting being the product of both the receiver spectrum slanting and the transmitter spectrum slanting. Thus the slanting as seen from this additional set of antenna elements may be normalized by that of the initial set of antenna elements to essentially obtain the spectrum slanting of the receiver only.

A second method is based on small changes of the antenna beam direction and evaluation of how spectrum slanting varies as a function of the antenna beam direction. More specifically, with reference to FIG. 12 which generally corresponds to FIG. 10, the antenna beam direction can be varied from a first antenna beam direction 20b to at least one more antenna beam direction 20a, 20c, but only in one plane 21a, 21b at a time; a plane that includes the first antenna beam direction 20b. A few different planes 21a, 21b can be evaluated, and the plane with the least variation on spectrum slanting—for the different directions within said plane—will also be the most representative for the spectrum slanting originating from the transmitter. A variation of the beam direction in a plane that is formed by the first signal line $L_i$ and the current antenna beam direction will have the least variation in spectrum slanting, and that spectrum slanting will be dominated by the transmitter.

Other methods are of course conceivable. Generally, the control unit 8 is arranged to determine a degree of angular pointing deviation for the received signal 11a, 11b, 11c; 11a', 11b' relative the antenna beam 9; 9a, 9b, 9c by means of the degree of slant of the relative power 10a, 10b, 10c of a received signal, from the lowest frequency $f_{low}$ to the highest frequency $f_{high}$ along the second set of antenna elements 12'.

When detection of transmitter slanting is possible, an indication of error in direction, degree of spectrum slanting, or related metric, these may be periodically communicated, by the node measuring spectrum slanting, to the transmitting node to serve as input for said node's beam tracking mechanism. Alternatively, when a metric exceeds a certain threshold, this event or state may be periodically communicated to the transmitting node as an indication that the transmitting node should correct its beam direction when communicating with the node reporting said spectrum slanting metric or event/state.

The present invention may be implemented in a node such as a base station/access node (eNB), as opposed to a user terminal, due to complexity and power consumption, but also because an eNB also is more likely to contain several antenna arrays to cover a larger spherical sector than what is possible with a single array antenna. Furthermore, in many cases the beam of a user terminal is anticipated to be substantially wider than that of the eNB, in which case the slanting originating from the user terminal's transmitter will be much smaller. Therefore, in many scenarios, there would be no need to distinguish the slanting of the receiver and the transmitter.

Figure 13:
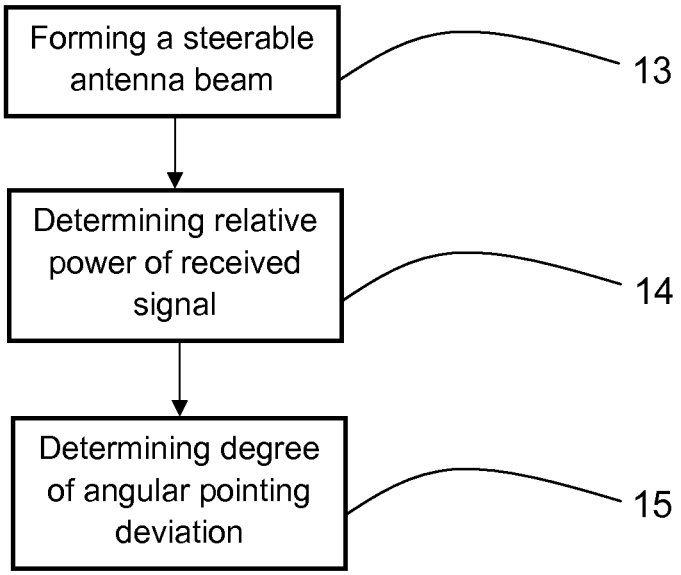
FIG. 13 shows a flowchart of a method according to the present invention.

With reference to FIG. 13, the present invention also relates to a method for determining a degree of angular pointing deviation $\beta_b$, $\beta_c$ for a steerable antenna beam 9; 9a, 9b, 9c relative a received signal 11a, 11b, 11c; 11a', 11b' at a node 1 with an antenna arrangement 2. The antenna arrangement 2 in turn has at least one array antenna 3, 4, 5; 3', where each array antenna 3, 4, 5; 3' comprises a plurality of antenna elements 6, 6'. At least a first set of antenna elements 7, 7' is formed from said plurality of antenna elements 6, 6'. The method comprises the following three steps:

13: Forming said steerable antenna beam 9; 9*a*, 9*b*, 9*c*, which is steerable to a certain pointing angle $\varphi$, $\varphi_1$, $\varphi_2$ in at least one plane by means of phase shifts applied to the antenna elements in said set of antenna elements 7, 7' within a certain bandwidth B. Said bandwidth has a certain lowest frequency $f_{low}$, a certain highest frequency $f_{high}$, and a certain centre frequency $f_c$, symmetrically located between the lowest frequency $f_{low}$ and the highest frequency $f_{high}$.

14: Determining the relative power 10*a*, 10*b*, 10*c* of a received signal 11*a*, 11*b*, 11*c*; 11*a*', 11*b*' at a plurality of frequencies in the frequency band B, from the lowest frequency $f_{low}$ to the highest frequency $f_{high}$.

15: Determining the degree of angular pointing deviation $\beta_b$, $\beta_c$ for the antenna beam 9; 9*a*, 9*b*, 9*c* relative the received signal 11*a*, 11*b*, 11*c*; 11*a*', 11*b*' by means of the degree of slant of the relative power 10*a*, 10*b*, 10*c* of the received signal 11*a*, 11*b*, 11*c*; 11*a*', 11*b*', from the lowest frequency $f_{low}$ to the highest frequency $f_{high}$.

The present invention is not limited to the examples above, but may vary freely within the scope of the appended claims. For example the node 1 may comprise one or several antenna arrangements, each antenna arrangement being arranged to cover a certain sector. The sector or sectors do not have to lie in an azimuth plane, by may lie in any suitable plane, such as for example an elevation plane.

Furthermore, each set of antenna elements may comprise those antenna elements that are positioned closer to a straight line $L_1$, $L_1'$, $L_2'$ than any other antenna elements along said line $L_1$, $L_1'$, $L_2'$. This is for example the case in the first example and the second example above, where the antenna elements follow the lines. But if, for example, a straight line would cross the array antenna 3' shown in FIG. 9 at an angle with respect to the first straight line L1' all elements would in some cases not exactly follow that straight line. Then, as stated above, a set of antenna elements would comprise those antenna elements that are positioned closer to that straight line than any other antenna elements along that straight line. As a consequence of that, the antenna elements comprised in that set of antenna elements would not lie in a straight line.

Where there are two sets of antenna elements, the second straight line $L_2'$ has an extension with a direction that differs from the direction of the first straight line's $L_1'$ extension, in the particular second example with reference to FIG. 9, they are mutually orthogonal.

The lines do not have to be straight, but may follow any form such as a circular form as shown in FIG. 11. In this corresponding case, a set of antenna elements may be formed from those antenna elements that are positioned closer to the signal circle $L_o''$ than any other antenna elements along the signal circle $L_o''$.

More generally, each set of antenna elements may be formed in any suitable way, not having to follow any lines. A set of antenna elements may for example comprise groups of antenna elements which are separated by antenna elements not being part of that specific set of antenna elements. Certain antenna elements may be a part of several sets of antenna elements.

It is conceivable that one array antenna at the node 1 is arranged for communication with a user terminal, and that another array antenna at the node 1 is arranged for determining a degree of angular pointing deviation $\beta_b$, $\beta_c$.

For each set of antenna elements, the control unit 8 is arranged to determine the sign of any angular pointing deviation $\beta_b$, $\beta_c$ by means of the present pointing angle $\varphi$, $\varphi_1$, $\varphi_2$.

Figure 12:
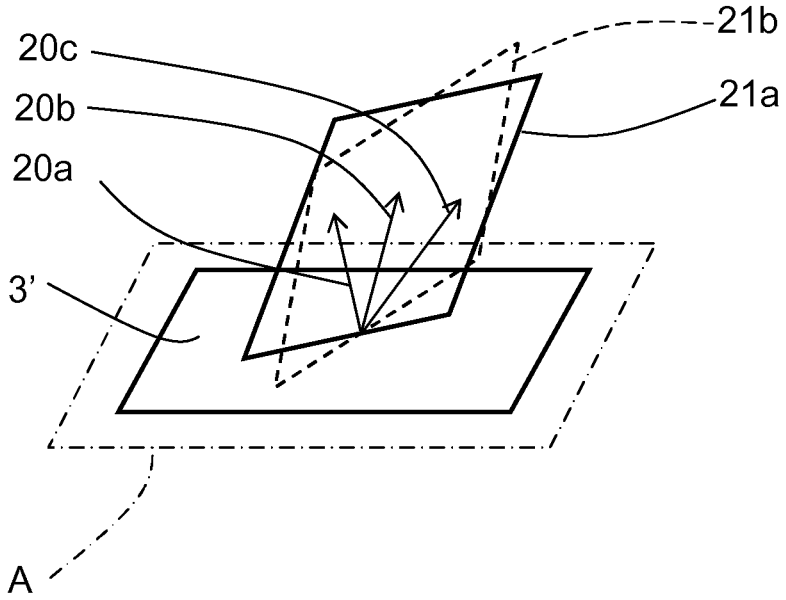
FIG. 12 illustrates a second method for distinguishing the spectrum slanting of the receiver from that of the transmitter.

The wavefronts of FIG. 10, FIG. 11 and FIG. 12 are not indicated in FIG. 1 for reasons of clarity.

The present invention relates to a wireless communication system node, which is a node that is suitable for use in a wireless communication system.

The control unit 8 may be positioned at any suitable place at the node.

The invention claimed is:

1. A wireless communication system node, where the node comprises an antenna arrangement, which antenna arrangement in turn comprises at least one array antenna, where each array antenna comprises a plurality of antenna elements, where at least a first set of antenna elements is formed from said plurality of antenna elements, and wherein the node further comprises a control unit, where, for at least one set of antenna elements, the control unit is arranged to:

form an antenna beam that is steerable to a certain pointing angle ($\varphi$, $\varphi_1$, $\varphi_2$) in at least one plane by phase shifts applied to the antenna elements in said set of antenna elements, where the antenna beam is formed for a signal having a certain bandwidth (B) with a certain lowest frequency ($f_{low}$), a certain highest frequency ($f_{high}$), and a certain centre frequency ($f_c$), symmetrically located between the lowest frequency ($f_{low}$) and the highest frequency ($f_{high}$);

determine the relative power of a received signal at a plurality of frequencies in the frequency band (B), from the lowest frequency ($f_{low}$) to the highest frequency ($f_{high}$); and determine a degree of angular pointing deviation ($\beta_b$, $\beta_c$) for the antenna beam relative to the received signal by the degree of slant of the relative power of the received signal, from the lowest frequency ($f_{low}$) to the highest frequency ($f_{high}$).

2. The node according to claim 1, wherein each set of antenna elements comprises those antenna elements that are positioned closer to a straight line ($L_1$, $L_1'$, $L_2'$) than any other antenna elements along said line ($L_1$, $L_1'$, $L_2'$).

3. The node according to claim 2, wherein at least one array antenna comprises a plurality of antenna elements in two dimensions (x, y) in a plane (A), where the first set of antenna elements comprises those antenna elements that are positioned closer to a first straight line ($L_1'$) than any other antenna elements along said first straight line ($L_1'$), and where a second set of antenna elements from said plurality of antenna elements comprises antenna elements that are positioned closer to a second straight line ($L_2'$) than any other antenna elements along said second straight line ($L_2'$), the second straight line ($L_2'$) having an extension with a direction that differs from the direction of the first straight line's ($L_1'$) extension, where the control unit is arranged to determine a degree of angular pointing deviation ($\beta_b$, $\beta_c$) for the antenna beam relative to the received signal for the second set of antenna elements in the same way as for the first set of antenna elements.

4. The node according to claim 3, wherein the first straight line ($L_1'$) and the second straight line ($L_2'$) are mutually perpendicular.

5. The node according to claim 3, wherein the control unit is arranged to alter which antenna elements that are comprised in the sets of antenna elements such that those parts of an incoming signal that reach the array antenna, reach the second straight line ($L_2'$) as simultaneous as possible.

6. The node according to claim 5, wherein the control unit is arranged to alter which antenna elements that are comprised in the second set of antenna elements based on determined relative power of a received signal at a plurality of frequencies in the frequency band (B), from the lowest frequency ($f_{low}$) to the highest frequency ($f_{high}$) at different directions of said antenna beam along at least one plane.

7. The node according to claim 5, wherein the control unit is arranged to determine a degree of angular pointing deviation for the received signal relative to the antenna beam by the degree of slant of the relative power of a received signal from the lowest frequency ($f_{low}$) to the highest frequency ($f_{high}$) along the second set of antenna elements.

8. The node according to claim 1, wherein for each set of antenna elements, the control unit is arranged to determine the sign of any angular pointing deviation ($\beta_b$, $\beta_c$) by means of the present pointing angle ($\varphi$, $\varphi_1$, $\varphi_2$).

9. A method for determining a degree of angular pointing deviation ($\beta_b$, $\beta_c$) for a steerable antenna beam relative a received signal at a node with an antenna arrangement, where the antenna arrangement in turn comprises at least one array antenna, where each array antenna comprises a plurality of antenna elements, where at least a first set of antenna elements is formed from said plurality of antenna elements, wherein the method comprises the steps:

forming said steerable antenna beam, which is steerable to a certain pointing angle ($\varphi$, $\varphi_1$, $\varphi_2$) in at least one plane by phase shifts applied to the antenna elements in said set of antenna elements, where the antenna beam is formed for a signal having a certain bandwidth (B) with a certain lowest frequency ($f_{low}$), a certain highest frequency ($f_{high}$), and a certain centre frequency ($f_c$), symmetrically located between the lowest frequency ($f_{low}$) and the highest frequency ($f_{high}$);

determining the relative power of a received signal at a plurality of frequencies in the frequency band (B), from the lowest frequency ($f_{low}$) to the highest frequency ($f_{high}$); and determining the degree of angular pointing deviation ($\beta_b$, $\beta_c$) for the antenna beam relative the received signal by means of the degree of slant of the relative power of the received signal, from the lowest frequency ($f_{low}$) to the highest frequency ($f_{high}$).

10. The method according to claim 9, wherein each set of antenna elements uses those antenna elements that are positioned closer to a straight line ($L_1$, $L_1'$, $L_2'$) than any other antenna elements along said line ($L_1$, $L_1'$, $L_2'$).

11. The method according to claim 10, wherein at least one array antenna has a plurality of antenna elements in two dimensions (x, y) in a plane (A), where the first set of antenna elements comprises those antenna elements that are positioned closer to a first straight line $L_1'$) than any other antenna elements along said first straight line ($L_1'$), and where a second set of antenna elements from said plurality of antenna elements comprises antenna elements that are positioned closer to a second straight line ($L_2'$) than any other antenna elements along said second straight line ($L_2'$), the second straight line ($L_2'$) having an extension with a direction that differs from the direction of the first straight line's ($L_1'$) extension, where the method further comprises the step of determining the degree of angular pointing deviation ($\beta_b$, $\beta_c$) for the antenna beam relative the received signal for the second set of antenna elements in the same way as for the first set of antenna elements.

12. The method according to claim 11, wherein the first straight line ($L_1'$) and the second straight line ($L_2'$) are mutually perpendicular.

13. The method according to claim 11, wherein the method comprises the step of altering which antenna elements that are used in the sets of antenna elements such that those parts of an incoming signal that reach the array antenna, reach the second straight line ($L_2'$) as simultaneous as possible.

14. The method according to claim 13, wherein the method comprises the step of alter which antenna elements that are used in the second set of antenna elements based on determined relative power of a received signal at a plurality of frequencies in the frequency band (B), from the lowest frequency ($f_{low}$) to the highest frequency ($f_{high}$) at different directions of said antenna beam along at least one plane.

15. The method according to claim 13, wherein the method comprises the step of determining a degree of angular pointing deviation for the received signal relative the antenna beam by means of the degree of slant of the relative power of a received signal from the lowest frequency ($f_{low}$) to the highest frequency ($f_{high}$) along the second set of antenna elements.

16. The method according to claim 9, wherein the method comprises the step of using the present pointing angle ($\varphi$, $\varphi_1$, $\varphi_2$) for determining the sign of any angular pointing deviation ($\beta_b$, $\beta_c$).

* * * * *